US007443356B2

(12) United States Patent
Roberts et al.

(10) Patent No.: US 7,443,356 B2
(45) Date of Patent: Oct. 28, 2008

(54) ANTENNA MODULE

(75) Inventors: Arthur Roberts, Pukerua Bay (NZ); Coskun Nalbant, Balwyn North (AU); Noel McDonald, Croydon (AU)

(73) Assignee: ALCATEL, Paris (FR)

( * ) Notice: Subject to any disclaimer, the term of this patent is extended or adjusted under 35 U.S.C. 154(b) by 0 days.

(21) Appl. No.: 11/029,457

(22) Filed: Jan. 6, 2005

(65) Prior Publication Data

US 2005/0184921 A1 Aug. 25, 2005

Related U.S. Application Data

(60) Provisional application No. 60/545,896, filed on Feb. 20, 2004.

(51) Int. Cl.
*H01Q 21/26* (2006.01)
*H01Q 9/16* (2006.01)

(52) U.S. Cl. ..... 343/797; 343/793

(58) Field of Classification Search ..... 343/797, 343/798, 700 MS, 772, 756, 793–795
See application file for complete search history.

(56) References Cited

U.S. PATENT DOCUMENTS 6,023,244 A 2/2000 Snygg et al.
6,025,812 A * 2/2000 Gabriel et al. ..... 343/797
6,028,563 A 2/2000 Higgins
6,067,053 A * 5/2000 Runyon et al. ..... 343/797
6,072,439 A 6/2000 Ippolito et al.
6,515,633 B2 * 2/2003 Ippolito ..... 343/797
6,646,611 B2 * 11/2003 Plet et al. ..... 343/702
6,747,606 B2 * 6/2004 Harel et al. ..... 343/808
6,980,167 B2 * 12/2005 Brachat et al. ..... 343/772
2002/0140618 A1 * 10/2002 Plet et al. ..... 343/797
2003/0214452 A1 11/2003 Ippolito
2005/0110699 A1 * 5/2005 Timofeev et al. ..... 343/797

* cited by examiner

*Primary Examiner*—Hung T Vy
(74) *Attorney, Agent, or Firm*—Sughrue Mion, PLLC

(57) ABSTRACT

An antenna module, in particular for a base station of a cellular mobile radio network, comprising a group of radiating elements capable of receiving and/or transmitting electromagnetic waves having at least two different, preferably linear orthogonal, polarizations, said antenna module further comprising at least one passive decoupling element. Said decoupling element extends with its longest dimension in a direction which is substantially perpendicular to a direction of propagation of said electromagnetic waves and/or substantially parallel to a ground plane and thus improves a degree of decoupling between said polarizations.

13 Claims, 3 Drawing Sheets

ANTENNA MODULE

The invention is based on a priority provisional application U.S. 60/545,896 filed Feb. 20, 2004 which is hereby incorporated by reference.

BACKGROUND OF THE INVENTION

The present invention relates to an antenna module, in particular for a base station of a cellular mobile radio network, comprising a radiating element or a plurality of radiating elements forming a group of radiating elements capable of receiving and/or transmitting electromagnetic waves having at least two different, preferably linear orthogonal, polarizations, said antenna module further comprising at least one passive decoupling element.

Such antenna modules are e.g. used to provide radio coverage for cellular communications networks and require a proper decoupling between electromagnetic waves of a first polarization plane and a second polarization plane. Said different polarizations can be used to provide polarization diversity when receiving signals.

SUMMARY OF THE INVENTION

It is an object of the present invention to provide an improved antenna module with a high degree of decoupling between the different polarizations.

Regarding an antenna module of the above mentioned kind, this object is achieved according to the present invention by said decoupling element extending with its longest dimension in a direction which is substantially perpendicular to a direction of propagation of said electromagnetic waves and/or substantially parallel to a ground plane. It has been found out and proven by measurements, that the inventive arrangement of said decoupling element provides superior decoupling capabilities. Industry-standard isolation specifications can be achieved with the inventive decoupling element.

According to an advantageous embodiment of the present invention, said decoupling element comprises electrically conductive material. Alternatively, said decoupling element may entirely be made of conductive material.

A further advantageous embodiment of the present invention is characterized in that said decoupling element is attached to a ground plane of said antenna module by means of dielectric spacers. This variant provides a capacitive coupling of the decoupling element to the ground plane. Using said dielectric spacers provides for easy mounting of said decoupling element, since only one or more holes are required within said decoupling element the spacers are attached to e.g. via a snap-in mounting.

Alternatively, said decoupling element may also be directly attached to the ground plane.

Another embodiment of the present invention is characterized by said decoupling element comprising at least a first section having a first length. According to a further advantageous embodiment of the present invention, said decoupling element comprises a second section having a second length, wherein said second section is extending in a direction which is substantially perpendicular to said first section or a direction the first section is extending in, respectively.

A further advantageous embodiment of the present invention is characterized in that said second length, i.e. the length of the second section, is smaller than said first length, i.e. the length of said first section.

According to a further advantageous embodiment of the present invention, said first section and said second section of said decoupling element form an "L"-shape. To obtain said "L"-shape, for instance a rectangular piece of sheet metal may be bent accordingly. Hence a very economic mode of manufacturing the inventive decoupling element is possible.

According to a further advantageous embodiment, a dimension of the decoupling element in a direction of propagation of said electromagnetic waves is less than any other dimension of said decoupling element in other directions. For instance, with an inventive decoupling element comprising said two sections which are substantially perpendicular to each other, on the one hand said first section with the first length is parallel to the ground plane, and said second section with the second length, which is smaller than the first length, is perpendicular to the ground plane. A further dimension of said decoupling element which is also parallel to said ground plane but perpendicular to said first section or a direction the first section is extending in, respectively, and which may be regarded as a width of the metal sheet constituting the inventive decoupling element, is larger than said second length of said second section. This way, a dimension of the decoupling element in a direction of propagation of said electromagnetic waves, i.e. the dimension or second length, respectively, of the second section, is less than any other dimension of said decoupling element in other directions, i.e. in directions parallel to the ground plane.

Yet another advantageous variant of the present invention is characterized by at least two groups of radiating elements. In comparison to a single group of radiating elements, a plurality of interconnected groups of radiating elements forming an antenna array enables to improve an antenna gain and/or a directivity of said antenna module.

According to a further advantageous embodiment of the present invention, a plurality of decoupling elements is provided for each group of radiating elements thereby further increasing a degree of decoupling between the different polarizations and/or groups of radiating elements.

Yet a further advantageous embodiment of the present invention provides at least two decoupling elements between adjacent groups of radiating elements which additionally reduces a coupling between adjacent groups of radiating elements.

A further embodiment of the present invention is characterized in that said first length of said first section is smaller than 25 percent of a distance between adjacent groups of radiating elements. According to tests, this comparatively small length has proven to provide for a sufficient degree of decoupling.

A further advantageous embodiment of the present invention is characterized in that said decoupling element faces the group of radiating elements to which it is assigned with its second section. I.e. the first, longer section of the decoupling element extends in a direction parallel to a ground plane of said antenna module, and said second, shorter section of the e.g. "L"-shaped decoupling element extends in a direction which is substantially perpendicular to said ground plane.

BRIEF DESCRIPTION OF THE DRAWINGS

Further details and advantages of the present invention are presented in the following detailed description with reference to the drawings, in which.

DETAILED DESCRIPTION OF THE DRAWINGS

Figure 1:
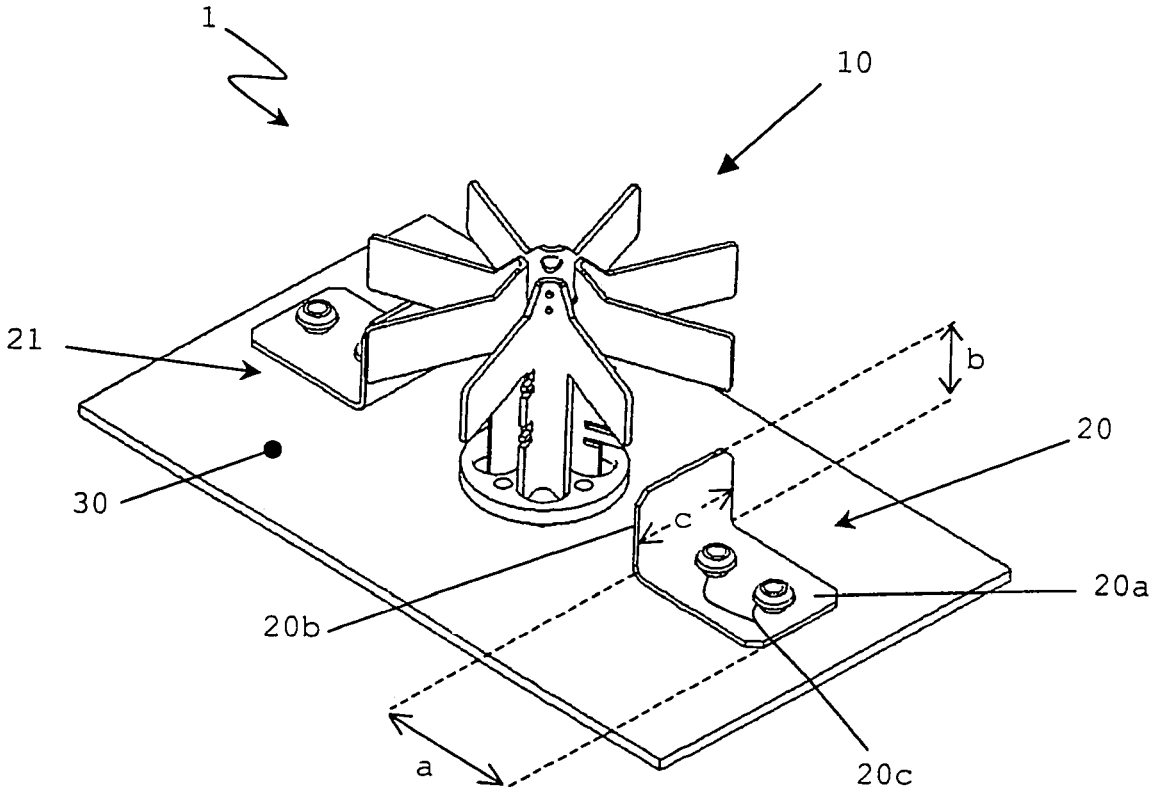
FIG. 1 shows a perspective view of a first embodiment of the present invention.

FIG. 1 shows an antenna module 1 that comprises a group 10 of radiating elements that are capable of receiving and/or transmitting electromagnetic waves having two different linear polarizations, the respective polarization planes of which being orthogonal to each other.

The antenna module 1 has a ground plane 30 operating as a reflector for electromagnetic waves thus increasing a directivity and an antenna gain of said group 10 of radiating elements. Adjacent to said group 10 of radiating elements, said antenna module 1 comprises two decoupling elements 20, 21, each of which is attached to said ground plane 30 by means of two dielectric spacers 20*c*.

Said decoupling elements 20, 21 consist of a conductive material and comprise an "L"-shape which is defined by a first section 20*a* and a second section 20*b* of said decoupling elements 20, 21.

As can be seen in FIG. 1, the first length a, i.e. the length of the first section 20*a*, is larger than the second length b of the second section 20*b*. Consequently, the decoupling elements 20, 21 extend with their longest dimension, i.e. said first length a, in a direction which is substantially parallel to the ground plane 30.

Figure 2:
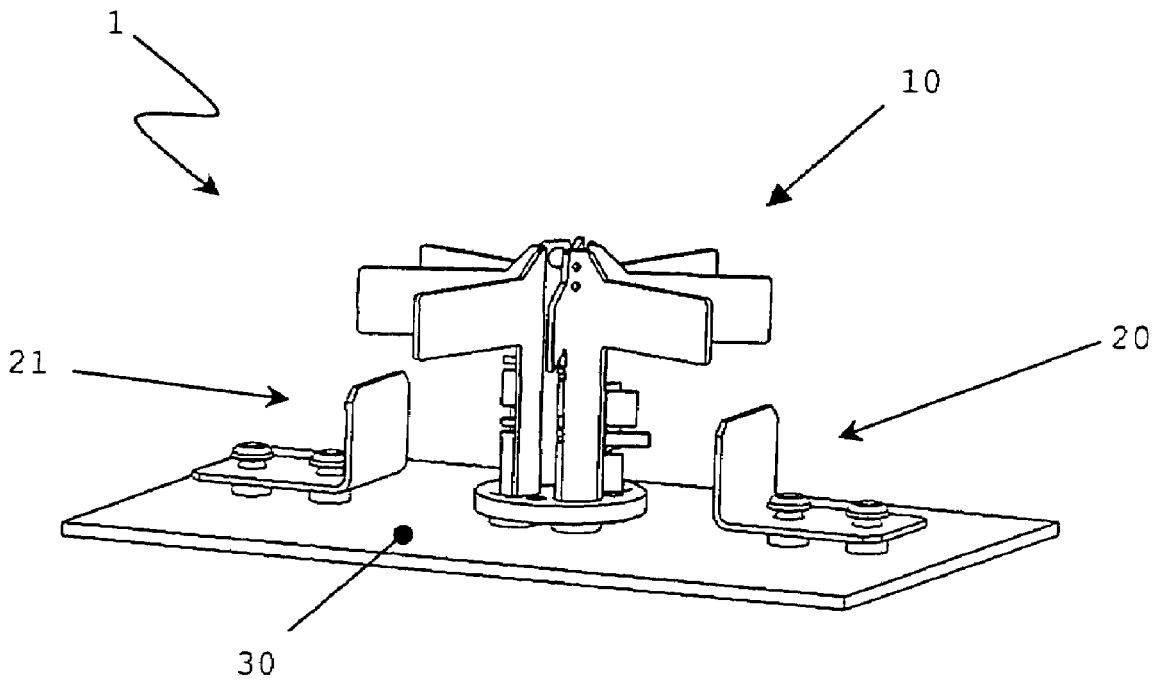
FIG. 2 shows a perspective view of the embodiment of FIG. 1 from a different viewpoint.

FIG. 2 shows the antenna module 1 of FIG. 1 from another viewpoint.

Figure 3:
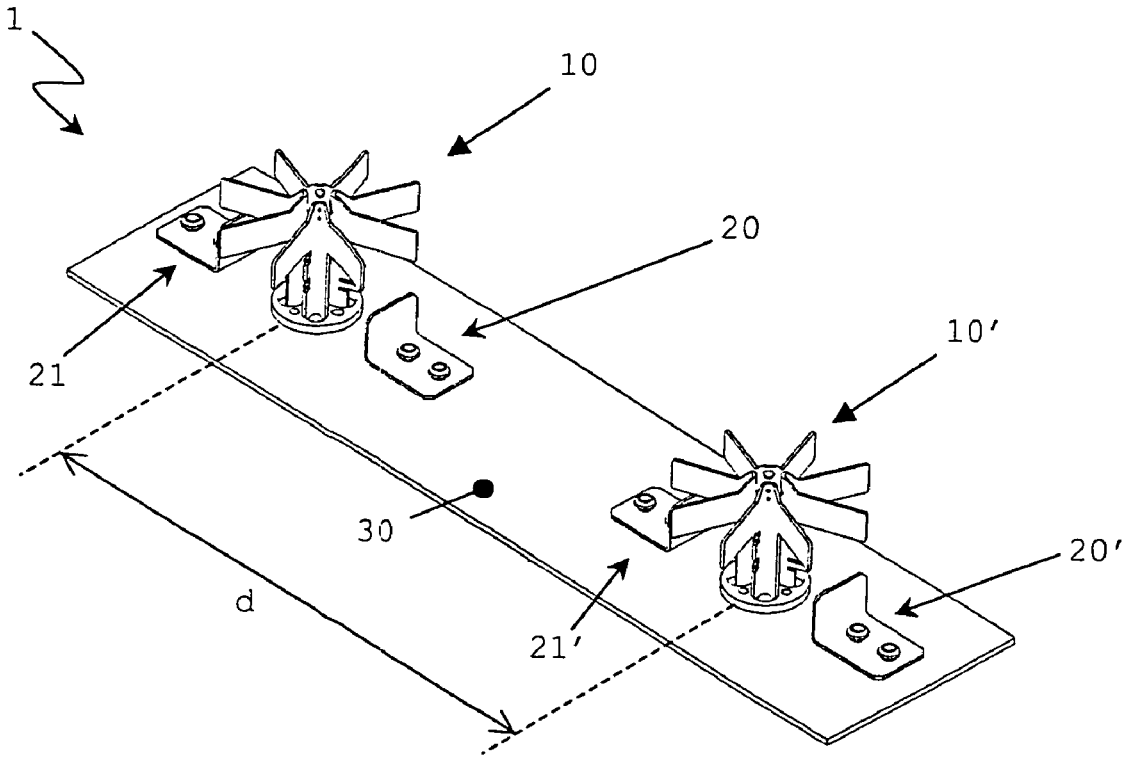
FIG. 3 shows a perspective view of a second embodiment of the present invention.

A further embodiment of the present invention is depicted in FIG. 3 showing an antenna module 1 that comprises two adjacent groups 10, 10' of radiating elements spaced apart from each other by the distance d. In comparison to the antenna module 1 of FIGS. 1 and 2, said antenna module 1 of FIG. 3 has an increased directivity.

As can be seen, each of the groups 10, 10' of radiating elements is provided with two decoupling elements 20, 21 and 20', 21'. Each decoupling element 20, 21, 20', 21' faces the group 10, 10' of radiating elements to which it is assigned with its second section 20*b* (cf. FIG. 1).

Furthermore, the first length a (cf. FIG. 1) of each decoupling element 20, 21, 20', 21' is smaller than 25 percent of the distance d between the adjacent groups 10, 10' of radiating elements.

According to a further embodiment of the present invention, it is also possible to provide more than two decoupling elements 20 for each group 10 of radiating elements, which is especially advantageous within antenna modules or antenna arrays, respectively, that comprise many groups of radiating elements.

According to a further advantageous embodiment, a dimension of the decoupling element 20 in a direction of propagation of said electromagnetic waves is less than any other dimension of said decoupling element in other directions. For instance, with an inventive decoupling element 20 as presented in FIG. 1, which is comprising said two sections 20*a*, 20*b* which are substantially perpendicular to each other, on the one hand said first section 20*a* with the first length a is parallel to the ground plane 30, and said second section 20*b* with the second length b, which is smaller than the first length a, is perpendicular to the ground plane 30. A further dimension of said decoupling element 20 which is also parallel to said ground plane 30 but perpendicular to said first section 20*a*, or a direction the first section 20*a* is extending in, respectively, and which may be regarded as a width c of the metal sheet constituting the decoupling element 20, is larger than said second length b of said second section 20*b*. This way, a dimension of the decoupling element 20 in a direction of propagation of said electromagnetic waves, i.e. the dimension or second length b, respectively, of the second section 20*b*, is less than any other dimension of said decoupling element 20 in other directions, i.e. in directions parallel to the ground plane 30.

The inventive antenna module is not limited to comprising a plurality of radiating elements, i.e. said group 10 of radiating elements. Said inventive antenna module may, according to another embodiment of the present invention, also comprise only one dual polarized radiating element such as a disk or patch antenna.

It is also possible to provide the inventive decoupling element 20 with a width c (FIG. 1*a*) that is smaller than said first length a and smaller than said second length b, i.e. a>b>c.

The invention claimed is:

1. An antenna module, comprising:

at least one radiating element capable of receiving and/or transmitting electromagnetic waves having at least two different polarizations; and passive decoupling elements, each having an "L" shape when seen from a view point looking across the width of the ground plane, and oriented with a face having a largest surface area being substantially parallel to a ground plane, arranged symmetrically regarding each at least one radiating element.

2. The antenna module according to claim 1, wherein each of said decoupling elements comprise electrically conductive material.

3. The antenna module according to claim 1, wherein each of said decoupling elements are attached to a ground plane of said antenna module by means of dielectric spacers.

4. The antenna module according to claim 1, wherein each of said decoupling elements comprise at least a first section having a first length.

5. The antenna module according to claim 4, wherein each of said decoupling elements comprise a second section having a second length, said second section extending in a direction which is substantially perpendicular to said first section.

6. The antenna module according to claim 5, wherein said second length is smaller than said first length.

7. The antenna module according to claim 1, wherein said antenna module includes a plurality of radiating elements arranged in at least two groups.

8. Antenna module according to claim 1, wherein said each of said decoupling elements face the group of radiating elements to which they are assigned with its second section.

9. Antenna module according to claim 1, wherein a dimension of each of the decoupling elements in a direction of propagation of said electromagnetic waves is less than any other dimension of said decoupling element in other directions.

10. Antenna module according to claim 1, wherein said each of said decoupling elements are capacitively coupled to a ground plane.

11. Antenna module according to claim 1, wherein at least two decoupling elements are provided between adjacent groups of radiating elements.

12. Antenna module according to claim 1, wherein each of the decoupling elements are directly attached to the ground plane.

13. An antenna module comprising:

at least one radiating element capable of receiving and/or transmitting electromagnetic waves having at least two different polarizations; and at least one passive decoupling element having an "L" shape , and oriented with a face having a largest surface area being substantially parallel to a ground plane, wherein said decoupling element comprises at least a first section having a first length; and wherein said first length of said first section is smaller than 25 percent of a distance between adjacent groups of radiating elements.

* * * * *